US005794486A

United States Patent [19]

Sugimoto et al.

[11] Patent Number: 5,794,486

[45] Date of Patent: Aug. 18, 1998

[54] UPPER TOOL HOLDER APPARATUS FOR PRESS BRAKE

[75] Inventors: Mamoru Sugimoto; Shiro Hayashi, both of Kanagawa, Japan

[73] Assignee: Amada Metrecs Company, Limited, Kanagawa, Japan

[21] Appl. No.: 720,013

[22] Filed: Sep. 27, 1996

[30] Foreign Application Priority Data

Oct. 2, 1995 [JP] Japan ..... 7-255153

[51] Int. Cl.[6] ..... B21D 5/02; B21D 5/04

[52] U.S. Cl. ..... 72/481.3; 72/481.6; 72/482.8; 72/462

[58] Field of Search ..... 72/481.1, 481.6, 72/482.6, 481.3, 482.91, 462

[56] References Cited

U.S. PATENT DOCUMENTS

| | | | |
|---|---|---|---|
| 4,993,255 | 2/1991 | Treillet | 72/462 |
| 5,511,407 | 4/1996 | Kawano | 72/482.91 |
| 5,513,514 | 5/1996 | Kawano | 72/482.91 |

FOREIGN PATENT DOCUMENTS

| | | | |
|---|---|---|---|
| 0387121 | 9/1990 | European Pat. Off. . | |
| 0569880 | 11/1993 | European Pat. Off. . | |
| 0644002 | 3/1995 | European Pat. Off. . | |
| 5-317974 | 12/1993 | Japan | 72/481.6 |
| 5-337553 | 12/1993 | Japan | 72/481.6 |
| 6-23436 | 2/1994 | Japan . | |
| 6-142767 | 5/1994 | Japan | 72/481.6 |
| 6262263 | 9/1994 | Japan . | |

*Primary Examiner*—David Jones

*Attorney, Agent, or Firm*—Greenblum & Bernstein P.L.C.

[57] ABSTRACT

An upper tool clamp is provided that is supported by a holder body arranged on an upper table of a press brake, so that the upper tool clamp can be oscillated between a clamped state and an unclamped state. A pressing member is mounted on a lower portion of the upper tool clamp in order to press an upper tool on an upper tool support portion which is mounted on a lower portion of the holder body. Further, an engage projection is formed on the upper tool clamp and freely engageable with a drop prevention groove which is formed on the upper tool. In addition, a first clamp/unclamp device and a second clamp/unclamp device are mounted on the holder body, respectively.

14 Claims, 12 Drawing Sheets

UPPER TOOL HOLDER APPARATUS FOR PRESS BRAKE

BACKGROUND OF THE INVENTION

1. Field of the invention

The present invention relates to an upper tool holder apparatus for a press brake and more particularly, to an upper tool holder apparatus in which an upper tool attached to an upper table for a press brake can be easily exchanged.

2. Description of the Related Art

A press brake is typically provided with an upper table (frequently referred to as an upper apron) and a lower table (frequently referred to as a lower apron) that are in mutually opposing positional relationship in the vertical direction with respect to each other. Further, any one of the upper and lower tables may be driven in the vertical direction as a ram.

In the above-mentioned construction of the press brake, a lower die is attached to an upper portion of the lower table and further, an upper tool (referred to as a punch) is attached to a lower portion of the upper table in order to bend a plate-shaped work to various desired shapes.

In the above-noted construction, after the work is positioned on the lower die, the upper tool is engaged with the lower die so that it is possible to bend the work to various desired shapes.

In the press brake, for example, since the upper tool must be exchanged according to the bending shapes of work and so on, a number of upper tool holder apparatuses are arranged on the lower portion of the upper table. That is, the upper tool is supported by a number of upper tool holder apparatuses in order to exchange the upper tool attached to the upper table.

In the conventional upper tool holder apparatus, an upper tool clamp member is attached to a holder body mounted on the lower portion of the upper table, and further fastened by use of fastening bolts in order to oscillate or move up and down. The upper portion of the upper tool inserted between the upper tool clamp and the holder body is: fastened by the fastening bolts, so that the upper portion of the upper tool can be strongly clamped by the upper tool clamp.

In the conventional construction, therefore, in order to exchange the upper tools attached to the upper table, a number of fastening bolts mounted on a number of upper tool holder apparatuses must be pivoted, thus causing a problem in that the upper tool exchange is extremely troublesome.

To overcome this problem, an upper tool holder apparatus has been developed such that the upper tools can be fastened or unfastened by use of an air cylinder mounted on the upper tool holder apparatus.

In the upper tool holder apparatus of this type, since an air cylinder must be provided for a number of upper tool holder apparatuses, respectively and since an air source is additionally necessary, there exists another problem in that the construction of the upper tool holder apparatus is complicated and thereby the cost thereof is relatively high.

In addition, in the conventional upper tool holder apparatus, there exists a danger that the upper tool drops when the upper tool clamp is released from an upper tool clamping force of the upper tool holder apparatus.

In the conventional upper tool holder apparatus, there also exists such a danger or problem in that the upper tool clamp member must first be half fastened to such an extent that the upper tool does not drop for alignment with the lower die, and after that the upper tool clamp member must be fully and tightly fastened after the upper tool and the lower die have been aligned with each other. As a result, there exists another problem in that the tool setting work is troublesome.

As prior art examples related to the present invention, there are EP 0 387 121 A1 (referred to as the first prior art below) and Japanese Patent Application Laid Open No. 6-23436 (referred to as the second prior art below).

In the first prior art, since the upper tool is clamped between the upper tool clamp member that is pivotally supported by the upper table of the press brake and the holder body so as to oscillate or move flexibly, the upper tool must be attached to or removed from the upper tool holder apparatus by pivoting the upper tool so as not to interfere with a pivotal axle of the upper tool clamp member. Accordingly, there exists another problem in that the shape of the upper tool is not simple (that is, complicated) and thereby the upper tool can not be processed easily.

In the second prior art, the upper tool can be attached to or removed from the upper tool holder apparatus by pivoting an operation lever provided on the upper tool holder apparatus from a clamp position to an unclamp position or vice versa to facilitate the upper tool exchange. However, in the second prior art, the upper tool is exchanged by the upper tool holder apparatus by shifting the upper tool in the longitudinal (the right and left) direction. As such, when some upper tool elements of a series of the split type upper tool of different length are required to be exchanged at the middle portion thereof, there exists a problem in that the upper tool exchange work is rather troublesome.

SUMMARY OF THE INVENTION

It is an object of the present invention to provide an upper tool holder apparatus for a press brake so that the upper tool can be easily clamped and unclamped on a plurality of holder bodies, or the upper tool can be easily clamped and unclamped on each holder when a plurality of holder bodies are horizontally arranged on the upper table.

To achieve the above-mentioned object, according to one aspect of the invention, an upper tool holder apparatus for a press brake comprises: an upper support portion for supporting an upper tool at a lower portion of a holder body which is removably arranged on an upper table for a press brake; a pressing portion which is mounted on a lower portion of an upper tool clamp which is supported by the holder body in order to oscillate by using a fulcrum existing at a vertically middle center portion of the holder body, so that the upper tool is pressed to the upper tool support portion; an engage projection freely engageable a drop prevention groove which is formed on the upper tool; a first clamp, unclamp means which is mounted on the holder body, the first clamp, unclamp means pressing an upper portion side of the upper tool clamp so that the upper tool is clamped by the upper tool clamp, and releasing a pressing force so that the upper tool is unclamped by the upper tool clamp; and a slide bar which is mounted in order to move in the right and left direction so that the first clamp, unclamp means can be operated.

In the above-mentioned construction, the upper tool clamp is pivotally supported by the holder body which is arranged on the upper table of the press brake. A pressing portion is arranged on the lower portion of the upper tool clamp, so that the upper tool can be pressed on the upper tool support portion mounted on the lower portion of the holder body. An engage projection is freely engageable with a drop prevention groove which is formed on the upper tool. Further, a first clamp, unclamp means is mounted on the holder body.

Accordingly, a slide bar is shifted in the right and left direction so that the first clamp, unclamp means can be operated, thereby, and the upper tool can be clamped or unclamped on the holder body by the upper tool clamp. Accordingly, the upper tool can be easily attached to and removed from the upper tool holder apparatus.

According to another aspect of the invention, an upper tool holder apparatus for a press brake further comprises a second clamp, unclamp means mounted on an upper portion of said upper tool clamp, wherein the second clamp, unclamp means presses the upper portion side of the upper tool clamp so that the upper tool is clamped by the upper tool clamp, and releases the pressing force so that the upper tool is unclamped by the upper tool clamp. An operation lever is also provided that is pivotably mounted on the upper tool clamp for operating the second clamp, unclamp means.

In the above-mentioned construction, for example, the operation lever is positioned just downward so that the upper tool can be easily clamped on the holder body by the upper tool clamp. Further, for example, the operation lever is pivoted counterclockwise so that the upper tool can be easily unclamped on the holder body by the upper tool clamp.

According to further aspect of the invention, an upper tool holder apparatus for a press brake comprises a plurality of holder bodies mounted in the right and left direction of the upper table; first clamp, unclamp means mounted on each holder body; and a slide bar movable in the right and left direction in order to operate the first clamp, unclamp means so that it is possible to be coupled and shut off by a coupling member.

In the above-mentioned construction, each slide bar is engaged with one another by an engage member. Accordingly, for example, when the right slide bar is shifted in the left direction, all the slide bars are shifted in the same direction so that the upper tool can be easily clamped on each holder body by each upper tool clamp of each holder body. Further, when the right slide bar is shifted in the right direction, all the slide bars are shifted in the same direction so that the upper tool: can be easily unclamped on each holder body by the upper tool clamp of each holder body.

Further, when a engage member at one position is shut off, since the slide bar existing at the shut-off position can not be shifted, only an engaged slide bar can shifted so that the same operation can be carried out.

Further, since each operation lever is mounted on each holder body, each operation lever is operated, respectively so that the upper tool can be clamped and unclamped on each holder body.

According to further aspect of the invention, an upper tool holder apparatus for a press brake is provided, wherein the first clamp, unclamp means comprises a pinion which is engaged with a rack formed in a longitudinal direction of the slide bar, a male worm screw which is integrated with a pivotal center, a female worm screw which is engaged with the male worm screw, an elastic member for allowing the female worm screw to be always pressed forward, a backup plate for supporting a reaction force of the elastic member, and a pusher portion which is integrated with the pinion so that it is possible to push on the upper tool clamp.

In the above-mentioned construction, when the slide lever is shifted in the left direction, a pinion can be rotated along a rack formed in the slide bar. Thereby, since a female worm screw is engaged with a male worm screw, the pinion is moved forward so that the upper tool can be pressed by the lower portion of the upper tool clamp. Accordingly, the upper tool can be easily clamped on the holder body.

When the slide lever is shifted in the right direction, the pinion can be rotated along a rack formed in the slide bar. Thereby, since the female worm screw is engaged with the male worm screw, the pinion is moved backward so that the upper tool clamp is released from a pressing force caused by the lower portion of the upper tool clamp. Accordingly, the upper tool can be easily unclamped on the holder body.

According to further aspect of the invention, an upper tool holder apparatus for a press brake is provided, wherein the second clamp, unclamp means comprises a three-threaded screw which is integrated with the operation lever in order to be engaged with a female screw of the upper tool clamp.

In the above-mentioned construction, the operation lever is pivoted in order to be positioned just downward, so that, by using the three-threaded screw, the upper tool can be pressed by the lower portion:,of the upper tool clamp. Accordingly, the upper tool can be easily clamped on the holder body. Further, for example, when the operation lever is pivoted counterclockwise, the upper tool clamp is released from the pressing force caused by the lower portion of the upper tool clamp, so that the upper tool can be easily unclamped on the holder body.

According to further aspect of the invention, an upper tool holder apparatus for a press brake is provided, wherein the upper tool is clamped by the upper tool clamp with the first clamp, unclamp means and the second clamp, unclamp means so that a clamp position of the upper tool clamp is positioned at the same position.

Accordingly, by using the first clamp, unclamp means, and the second clamp, unclamp means, the clamp position for clamping the upper tool is positioned at the same position. Thereby, each clamping force is urged equally, and further, the construction is made simpler.

According to further aspect of the invention, an upper tool holder apparatus for a press brake is provided, wherein the upper tool is clamped by the upper tool clamp with the first clamp, unclamp means and second clamp, unclamp means so that a clamp position of the upper tool clamp is positioned at two positions.

Accordingly, by the first clamp, unclamp means, and the second clamp, unclamp means, the upper tool can be shifted vertically at the first unclamp position and can be shifted forward at the second unclamp position.

DETAILED DESCRIPTION OF THE PREFERRED EMBODIMENTS

An embodiment of the present invention is explained below in detail using drawings.

Figure 1:
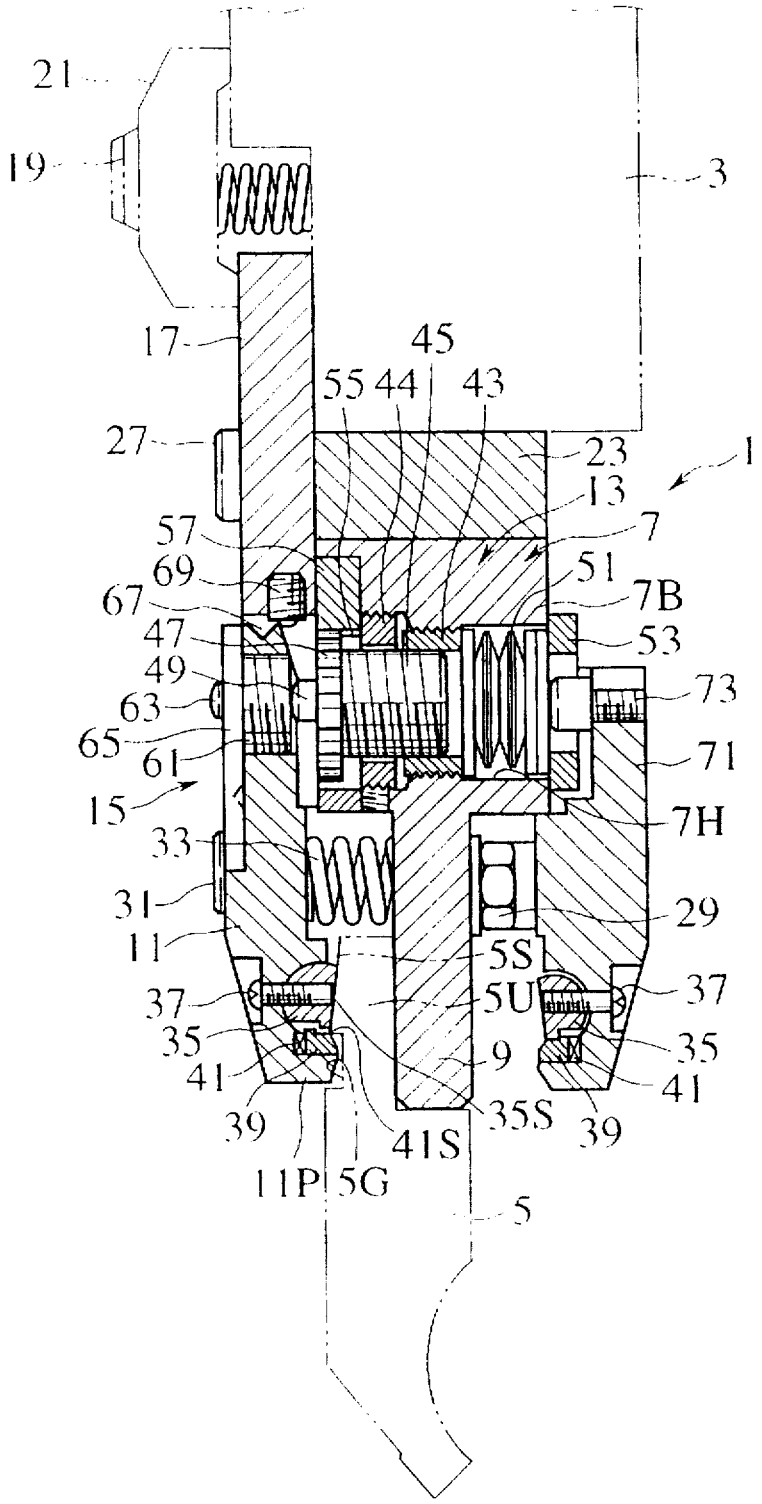
FIG. 1 is a cross-sectional view, taken along the line I—I shown in FIG. 2; according to an embodiment of an upper tool holder apparatus for a press brake of the present invention.
Figure 2:
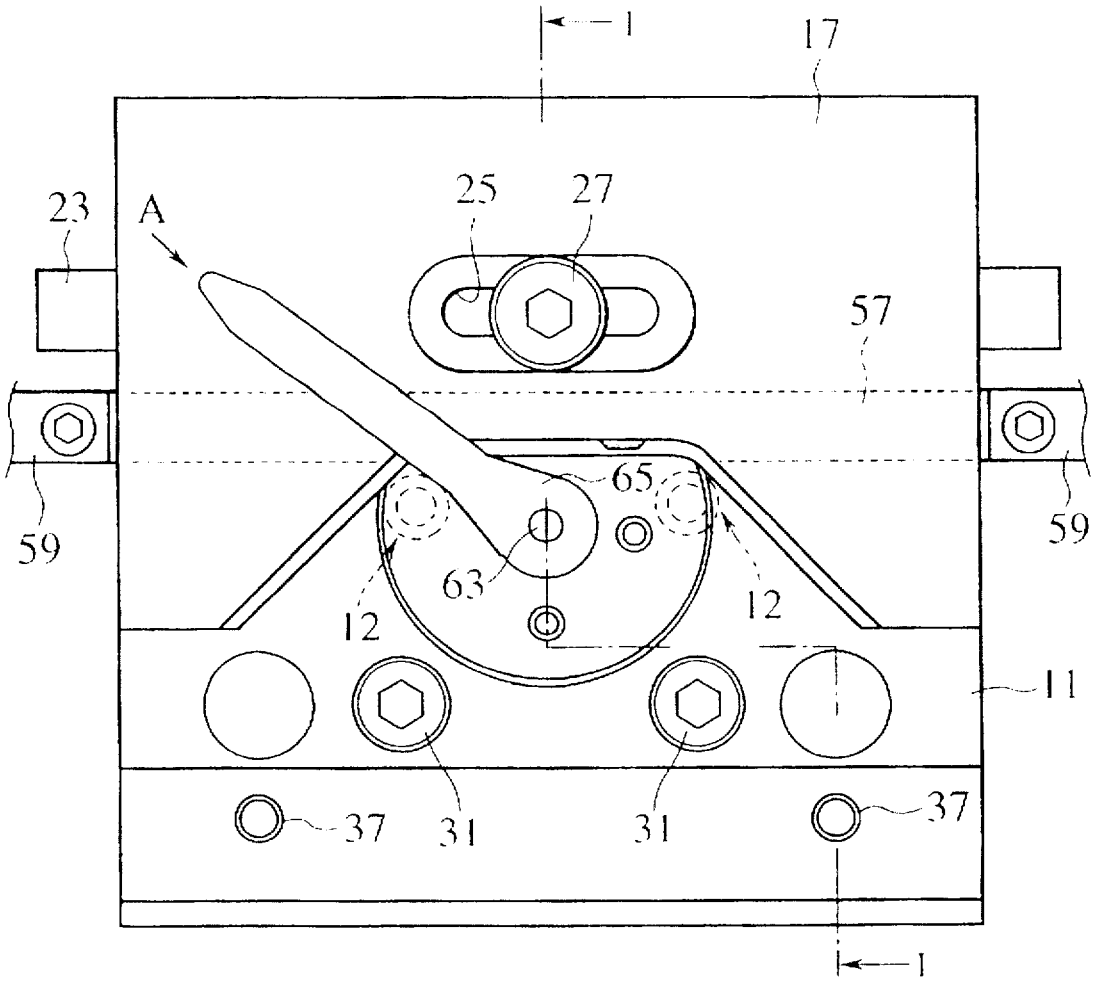
FIG. 2 is a front view of an upper tool holder apparatus for a press brake of the present invention.

Referring to FIGS. 1 and 2, according to an embodiment of the present invention, an upper tool holder apparatus 1 is removably mounted on a lower portion of an upper table 3 for a press brake (a general construction thereof is not shown). A plurality of upper tool holder apparatus 1 may be mounted on the lower portion of the upper table 3 in the right and left direction at appropriate Intervals so as to be used.

That is, with an upper tool 5 for the press brake, there are two cases to be used. In one case, only one upper tool whose length of a horizontal direction (a direction which is transversal to the paper in FIG. 1, or the right and left direction in FIG. 2) is longer than that of a vertical direction is used. In the other case, some upper tool elements of a series of the split type upper tool of different length are combined altogether in order to be used. In order to easily respond to either case a plurality of supper tool holder apparatuses 1 are mounted on the upper table 3 at appropriate intervals.

As clearly shown in FIG. 1, the upper tool holder apparatus 1 comprises a holder body 7 removably attached to the upper table 3, an upper tool clamp 11 for pressing and flexibly fixing an upper portion 5U of the upper tool 5 to an upper tool support portion 9 which is integral with a lower portion of the holder body 7, pressing and welding means 12 where the upper tool clamp 11 is always slightly pushed in a direction which the upper tool 5 is pressed and fixed, a first clamp, unclamp device 13, and a second clamp, unclamp device 15 such that the upper tool 5 can be clamped and unclamped on the upper tool portion 9 of the holder body 7 by the upper tool clamp 11.

In further detail, the holder body 7 is shaped so that the thin-wall upper tool support portion 9 is integral with the lower portion of a front and rear thick-wall block portion 7B. A mounting plate 17 projected upward is integral with a front-side (the left side in FIG. 1) of the block portion 7B of the holder body 7.

As shown in FIG. 2, the mounting plate 17 is composed of an opening portion whose shape is extended toward a lower center portion. As shown in FIG. 1, an upper projection of the mounting plate 17 is contacted with a front-side lower portion of the upper table 3. A fastening bolt 19 is thread-engaged with the upper table 3 in order to fasten a clamp jaw 21. With the fastening bolt 19 and clamp jaw 21, the upper projection of the mounting plate 17 is pressed and fixed to the upper table 3, so that the holder body 7 can be mounted on the upper table 3.

According to the embodiment, the holder body 7 is mounted apart from the mounting plate 17, respectively, so that the holder body 7 and the mounting plate 17 are fixed integrally. However, it is possible to consider the mounting plate 17 as a part of the holder body 7.

In order to adjust the vertical position of the holder body 7, a wedge portion member 23 is interposed between the upper surface of the holder body 7 and the lower surface of the upper table 3 in order to flexibly adjust the horizontal position. A fixed bolt 27 is thread-engaged with the wedge portion member 23 by passing through a longitudinal bore 25 mounted on the mounting plate 17.

According to the above-mentioned construction, the clamp jaw 21 is half fastened to such an extent that the holder body 7 does not drop for holding. Further, while the fixed bolt 27 remains unfastened, the wedge portion member 23 is adjusted in the right and left direction in FIG. 2 so that the holder body 7 can be adjusted upward and downward in response to the upper table 3.

The upper tool clamp 11 comprises a plate-shaped member whose thickness is substantially the same as the horizontal thickness of the holder body 7. A shape of the upper projection corresponds to that of the opening portion which is widened toward the end, so that the upper projection is formed at the corresponding opening portion of the mounting plate 17. The upper tool clamp 11 is supported by the holder body 7 in order to oscillate or move so that the upper portion 5U of the upper tool 5 is pressed and fixed between the upper tool support portion 9 and the upper tool clamp 11.

In further detail, a plurality of bores are provided on a middle center portion in vertical direction of the upper tool clamp 11. A mounting bolt 31 is passed through the bore in order to be thread-engaged with the upper tool support portion 9 horizontally through a nut 29 so that a head of the mounting bolt 31 can be oscillated flexibly. A coil spring 33 is elastically attached between the upper tool support portion 9 and the upper tool clamp 11 in order to be separated from each other.

In order to oscillate the upper tool clamp 11 smoothly, a contacting portion between the head of the mounting bolt 31 and the bore is formed as a spherical-shaped contact surface.

A drop prevention groove 5G is formed in the right and left direction at the upper portion, of the upper tool 5 so that an engage projection 11P for engaging flexibly can be formed at a lower end of the upper tool clamp 11 in order to project toward the upper tool support portion 9. A pressing member 35 is mounted on slightly upper portion than the engage projection 11P, so that the pressing member 35 is attached to a slant surface 5S on the upper portion 5U of the upper tool 5 in order to push the upper tool 5 on the upper tool support portion 9.

The pressing member 35 is shaped so that one part of a cylindrical surface is changed to a flat surface in order to pivot slightly toward the lower portion of the upper tool clamp 11 through a plurality of screws 37.

Further, a wedge piece 39 is mounted on the drop prevention groove 5G between the upper portion of the engage projection 11P and the pressing member 35 in order to move backward and forward flexibly. An elastic member 41 such as a coil spring, etc. which is elastically attached between the upper tool clamp 11 is urged, so that the wedge piece 39 is always welded in order to be engaged with the drop prevention groove 5G.

A movement of the wedge piece 37 by the welding force is restricted, since one part of the wedge piece 37 is contacted with one part of the pressing member 35. Accordingly, a slant surface 35S is formed at the upper surface on the end portion of the wedge piece 37 in order to remove an engagement with the drop prevention groove 5G easily.

The pressing member 35 is mounted on the lower portion of the upper tool clamp 11, so that the upper tool 5 is pressed and fixed to the upper tool support portion 9. The first clamp, unclamp device 13 is trimmed in a hole 7H which is mounted on a block portion 7B of the holder body 7 in the vertical direction, so that the clamp force thereof is provided for the upper tool clamp 11.

In further detail, as shown in FIG. 1, the first clamp, unclamp device 13 comprises a female screw of a dish spring 43, a male worm screw 45 engaged with an outside screw 44 which is mounted on the left side of the female screw of the dish spring 43 in FIG. 1, a pinion 47 integrated with the male worm screw 45, a pusher portion 49 integrated with the end portion of the pinion 47, and a backup plate 53 mounted on the right portion of the female screw of the a dish spring 43 in FIG. 1 through a dish spring 51 acting as an eccentric member.

A slide bar 57 is provided with a rack 55 engaged with the pinion 45, so that the slide bar 57 can be extended in the right and left direction (a direction which is transverse to the paper in FIG. 1, or in the right and left direction in FIG. 2) toward the block portion 7B of the holder body 7. Accordingly, the slide bar 57 can be attached in order to move flexibly. As shown in FIG. 2, a coupling member 59 is mounted on the right and left portion of the slide bar 57 in order to be coupled with another slide bar 57 (omitted in drawings) or to be shut off.

With the upper tool clamp 11, the upper tool 5 is clamped and unclamped on the upper tool support portion 9 which is integrated with the holder body 7. A second clamp, unclamp device 15 is mounted on the upper portion of the upper tool clamp 11 in order to clamp and unclamp the upper tool 5. In further detail, a three-threaded screw 61 is mounted inside the upper portion of the upper tool clamp 11 in order to be pivoted flexibly. An operation lever 65 is mounted on a pivotal center of the three-threaded screw 61 by using a screw 63 (see FIG. 2).

A ball plunger 69 is mounted on the mounting plate 17, so that an engage concave portion 67 such as a groove or a hole which is formed at the upper portion of the upper tool clamp 11 can be engaged and removed flexibly.

The engage concave portion 67 may be mounted on the mounting plate 25 so that the ball plunger 69 can be mounted on the upper tool clamp 11.

A rear upper tool clamp 71 is mounted on the rear surface (the right side in FIG. 1) of the holder body 7 by a bolt 73 in order to oscillate or move flexibly, so that the upper tool 5 is attached so as to be reversed front and rear.

According to the above-mentioned construction, a plurality of upper tool holder apparatuses 1 are mounted on the right and left side of the upper table 3 for the press brake at an appropriate interval. First, each slide bar 57 is pivoted in case of being coupled with the coupling member 59, as explained below.

For example, when the slide bar 57 exiting at the rightmost side is slid in the right direction by using a cylinder (not shown), the rack 55 which is provided with the slide bar 57 is engaged with the pinion 47. Thereby, the pinion 47 is rotated, and further the male worm screw 45 can be also rotated. Further, since the male worm screw 45 is engaged with the female screw of the dish spring 43, the male worm screw 45 and the pinion 47 compress the dish spring 51 in the right direction in order to permit movement.

As a result, when the pusher portion 49 is separated from the three-threaded screw 61, the upper tool clamp 11 is pivoted clockwise by the welding or urging force of the coil spring 33 in order to be changed to an unclamp state. Then, the upper tool clamp 11 is open by the pressing and welding means 12. Accordingly, an reaction force of the pressing and welding means 12 is resisted from the lower of the upper tool clamp 11. Thereby, the upper portion 5U of the upper tool 5 is inserted between the upper tool support portion 9 of the holder body 7 and the upper tool clamp 11, so that the upper tool 5 can be entered forward in order to be mounted.

The upper portion 5U of the upper tool 5 is inserted between the upper tool support portion 9 and the upper tool clamp 11. Then, by an action of the pressing and welding means 12, the upper tool clamp 11 is always and slightly pressed in a direction where the upper tool 5 is clamped, so as to be welded or fixed. Accordingly, the engage projection 11P is mounted on the lower portion of the upper tool clamp 11, so that the engage projection 11P can be engaged with the drop prevention groove 5G which is mounted on the upper tool 5.

Figure 3:
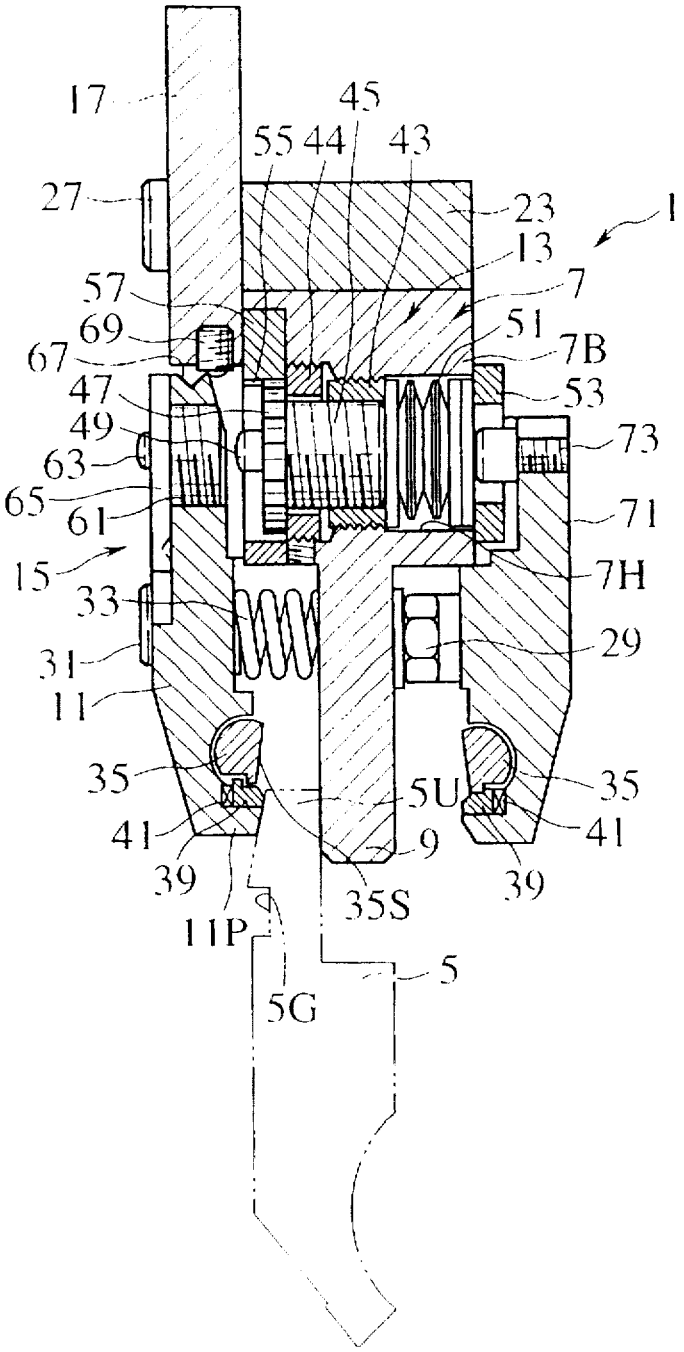
FIG. 3 is an illustration for assistance in explaining the effect when the upper tool is clamped and unclamped on the upper tool holder apparatus, according to an aspect of an upper tool holder apparatus for a press brake of the present invention.

Next, in the state shown in FIG. 3, when the slide bar 57 is slided in the left direction, the pinion 47 and the male worm screw 45 are rotated and further the male worm screw 45 is engaged with the female screw of the dish spring 43. Accordingly, the pinion 47 and the male worm screw 45 are moved in the left direction, that is, at the position shown in FIG. 4.

As a result, the three-threaded screw 61 remains slightly attached to the pusher portion 49 of the first clamp, unclamp means 13. Since in the upper tool 5, the drop prevention groove 5G remains engaged with the engage projection 11P of the upper tool clamp 11, it is possible to adjust (align) a position, and to remove and attach in a horizontal direction.

Figure 4:
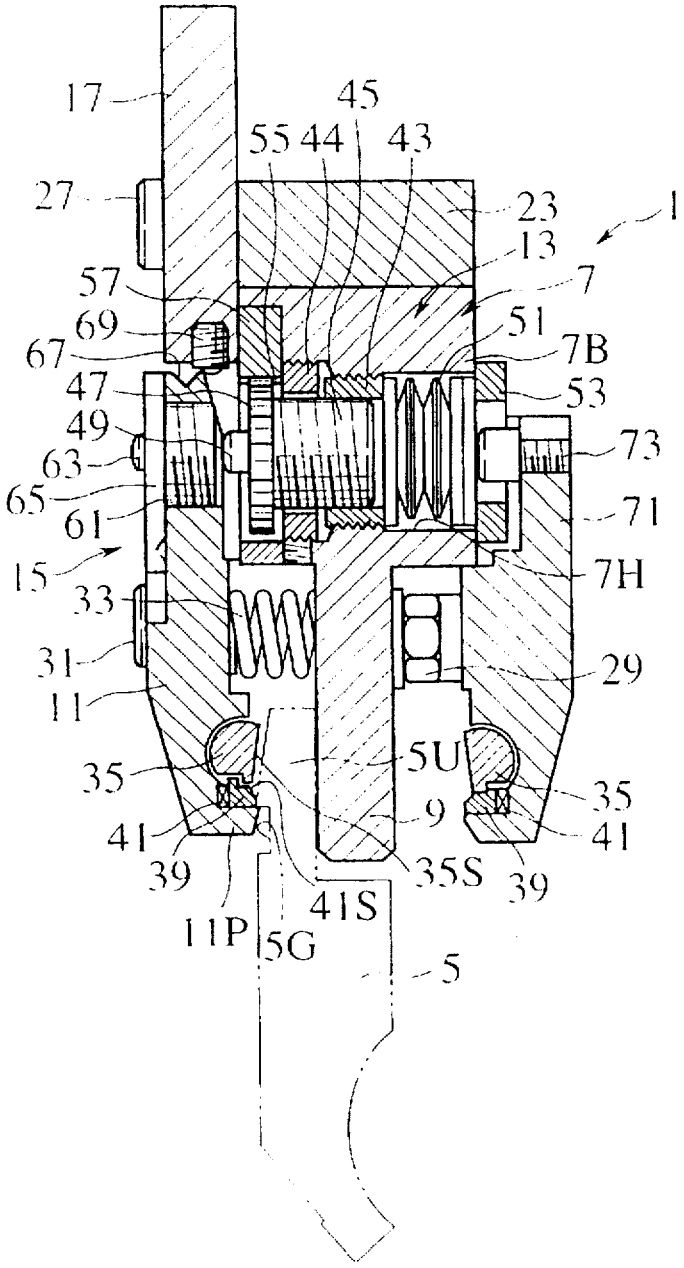
FIG. 4 is an illustration for assistance in explaining the effect when the upper tool is clamped and unclamped on the upper tool holder apparatus, according to an aspect of an upper tool holder apparatus for a press brake of the present invention.

Further, when the slide bar 57 is slid in the left direction from the position as shown in FIG. 4, the male worm screw 45 and the pinion 47 are moved in the left direction in the drawing of FIG. 1.

When the pinion 47 is shifted in the left direction in FIG. 1, in the pusher portion 49, the three-threaded screw 61, that is, the upper portion of the upper tool clamp 11 is pressed and welded by the welding force of the dish spring 51. As a result, the upper tool clamp 11 is pivoted counterclockwise in FIG. 1. Accordingly, the pressing member 35 is mounted on the lower portion of the upper tool clamp 11 in order to resist the welding force of the coil spring 33, so that the upper portion 5U of the upper tool 5 can be pressed. The upper tool 5 is incompletely clamped easily between the upper tool clamp 11 and the upper tool support portion 9.

Then, a table is moved upward and downward at a movable side of the press brake so that the upper tool 5 is engaged with a lower die (not shown). Thereby, the upper tool 5 can rise relatively between the upper tool support portion 9 and the upper tool clamp 11.

In this case, since the slant surface 5S of the upper tool 5 pushes the pressing member 35, the upper tool 5 rises relatively so that the upper tool clamp 11 can be pivoted clockwise. The three-threaded screw 61 pushes gradually the pusher portion 49 of the first clamp, unclamp device 13, so that a store force of the dish spring 51 is increased gradually. Accordingly, the upper tool clamp 11 is pushing and fixing the upper tool 5 gradually and forcefully in order to be completely clamped.

When a shoulder portion of the upper tool 5 is attached to a lower end surface of the upper tool support portion 9, the upper tool 5 is pressed and fixed to the upper tool support portion 9 by the upper tool clamp 11. Further, as shown in FIG. 1, the wedge piece 39 is engaged with the drop prevention groove 5G of the upper tool 5, so that a clearance between the engage projection 11P and the drop prevention groove 5G is reduced.

As described above, the wedge piece 39 is engaged with the drop prevention groove 5G of the upper tool 5 so that the clearance between the engage projection 11P and the drop prevention groove 5G remains reduced. In this case, even if the upper tool clamp 11 is released from pushing and fixing, the upper tool 5 does not drop due to its self-weight.

As described above, the upper tool clamp 11 pushes and fixes the upper tool 5 to the upper tool support portion 9 tightly, so that the work is bent, altogether by an operation of the lower die. Thereafter, in order to remove the upper tool 5, as shown in FIG. 3, the slide bar 57 is moved in the right direction so that the upper tool 5 can be unclamped easily.

Figure 5:
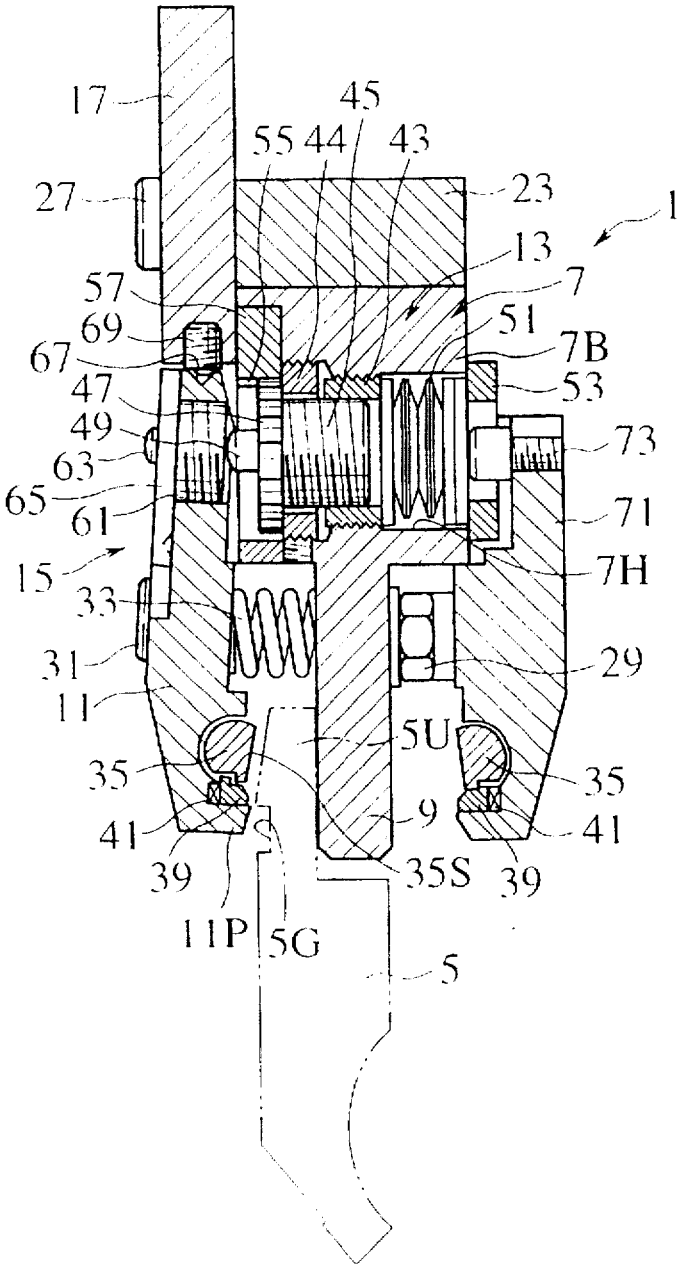
FIG. 5 is an illustration for assistance in explaining the effect when the upper tool is clamped and unclamped on the upper tool holder apparatus, according to an aspect of an upper tool holder apparatus for a press brake of the present invention.

Then, as shown in FIG. 5, the reaction force of the pressing and welding means 12 is resisted so that the lower side of the upper tool 5 is pivoted at this side. The engage concave portion 67 which is mounted on the upper portion of the upper tool clamp 11 is engaged with the ball plunger 69, so that the lower portion of the upper tool clamp 11 is open in order to be separated from the upper tool support portion 9. By pulling the upper tool 5 downward, it is possible to push the upper tool 5 forward in order to remove the upper tool 5 downward from the upper tool clamp 11, etc.

Thus, after removing the upper tool 5 in the downward direction, the slide bar 57 is slided in the left direction so that the pinion 45 and the male worm screw 47 is moved to the position as shown in FIG. 4 in the left direction. After the engagement between the engage concave portion 67 and the ball plunger 69 is released, the slide bar 57 is slid in the right direction so that the pinion 45 and the male worm screw 47 are moved to the position as shown in FIG. 3 in the right direction. Accordingly, as described above, the upper tool 5 is entered forward from the lower direction of the upper tool holder apparatus 1 in order to be mounted.

Each upper tool holder apparatus 1 is operated so that the upper tool 5 is clamped and unclamped by the second clamp, unclamp means 15, as explained below. First, when the operation lever 65 is pivoted so as to be positioned at a position A shown in FIG. 2, the upper tool holder apparatus 1 is changed to the state shown in FIG. 6. By a welding force of the coil spring 33, the upper tool clamp 11 is pivoted clockwise in order to be unclamped. Then, the upper tool clamp 11 remains open by the pressing and welding means 12. The reaction force of the pressing and welding means 12 is resisted from the lower portion of the upper tool clamp 11. Thereby, the upper portion 5U of the upper tool 5 is inserted between the upper tool support portion 9 of the holder body 7 and the upper tool clamp 11, so that the upper tool 5 can be entered forward in order to be mounted.

The upper portion 5U of the upper tool 5 is inserted between the upper tool support portion 9 and the upper tool clamp 11. Then, by an action of the pressing and welding means 12, the upper tool clamp 11 is always and slightly pressed in a direction where the upper tool 5 is clamped, so as to be welded. Accordingly, the engage projection 11P is mounted on the lower portion of the upper tool clamp 11, so that the engage projection 11P can be engaged with the drop prevention groove 5G which is mounted on the upper tool 5.

Figure 7:
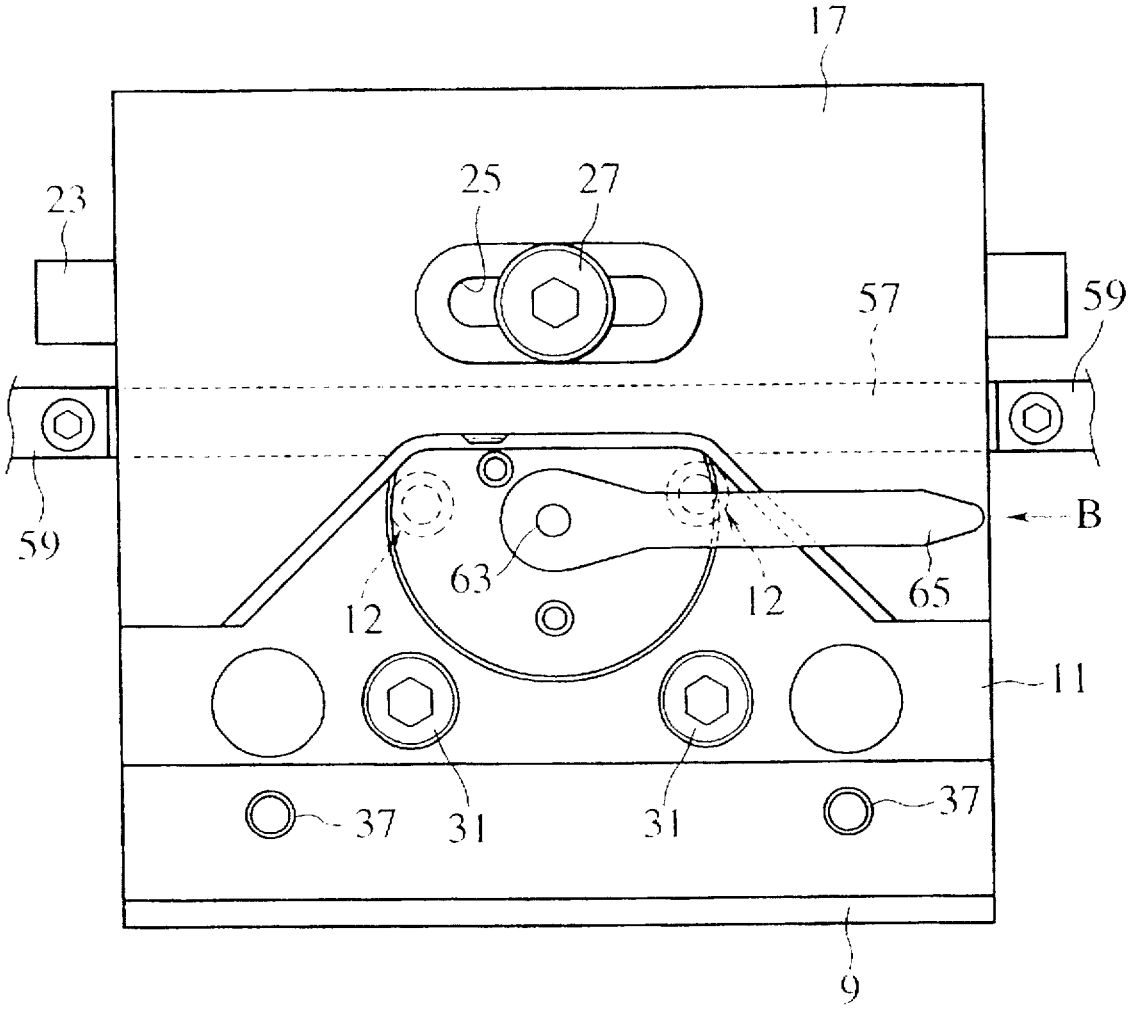
FIG. 7 is an illustration for assistance in explaining the effect when the upper tool is clamped and unclamped on the upper tool holder apparatus, according to an aspect of an upper tool holder apparatus for a press brake of the present invention.
Figure 8:
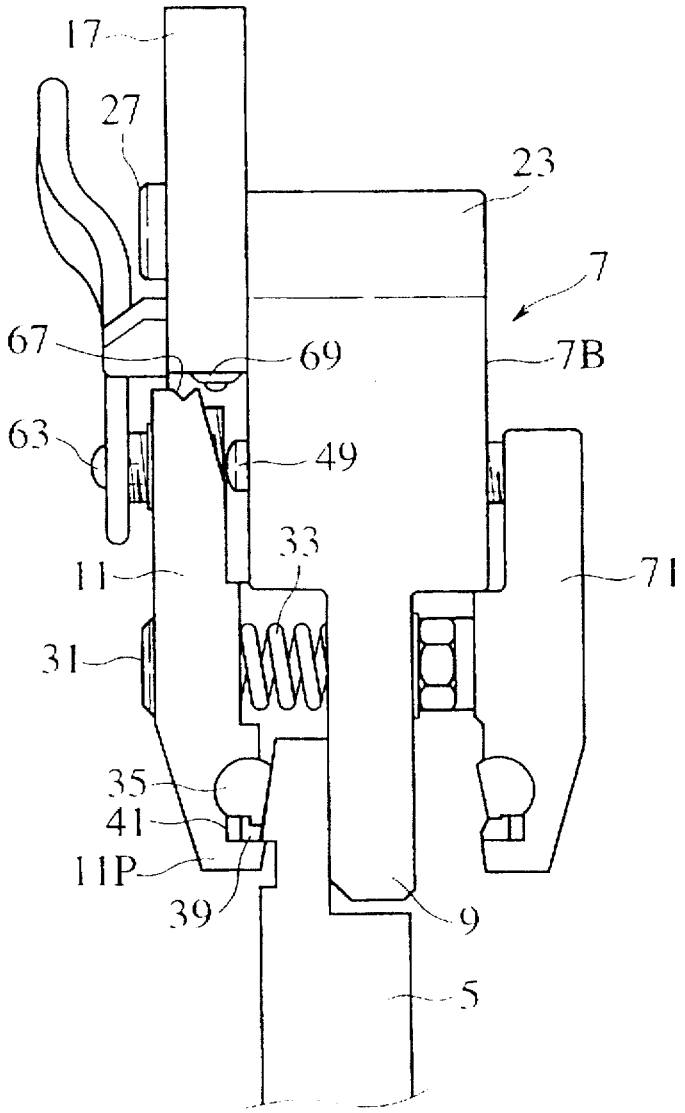
FIG. 8 is an illustration for assistance in explaining the effect when the upper tool is clamped and unclamped from the upper tool holder apparatus, according to an aspect of an upper tool holder apparatus for a press brake of the present invention.

Next, the operation lever 65 as shown in FIG. 2 is pivoted clockwise as shown in FIG. 7 in order to be positioned at a position B. As shown in FIG. 8, the three-threaded screw 61 is slightly attached to the pusher portion 49 of the first clamp, unclamp device 13. Since, in the upper tool 5, the drop prevention groove 5G remains engaged with the engage projection 11P of the upper tool clamp 11, it is possible to adjust (align) a position, and to remove and attach in a horizontal direction.

Figure 9:
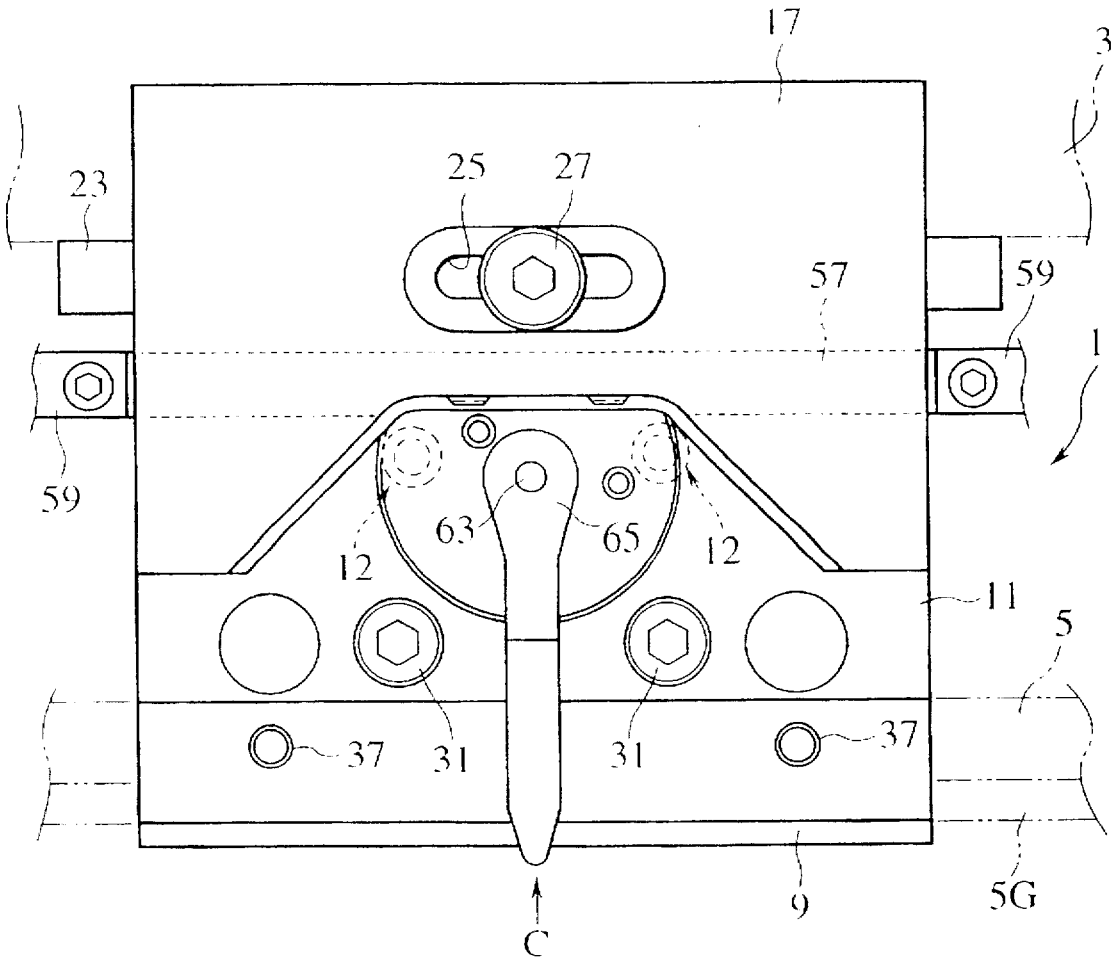
FIG. 9 is an illustration for assistance in explaining the effect when the upper tool is clamped and unclamped from the upper tool holder apparatus, according to an aspect of an upper tool holder apparatus for a press brake of the present invention.
Figure 10:
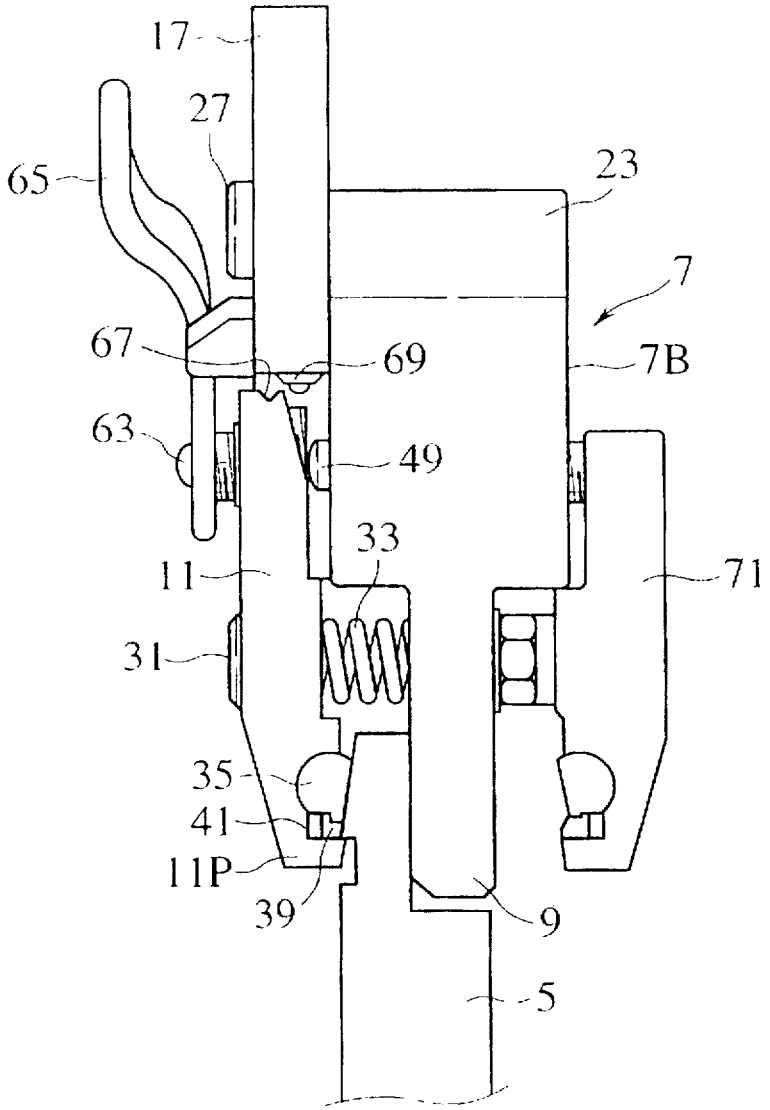
FIG. 10 is an illustration for assistance in explaining the effect when the upper tool is clamped and unclamped from the upper tool holder apparatus, according to an aspect of an upper tool holder apparatus for a press brake of the present invention.

Further, the operation lover 65 as shown in FIG. 7 is pivoted clockwise as shown in FIG. 9 in order to be positioned at a position C. As shown in FIG. 10, in the pusher 49, the three-threaded screw 61, that is, the upper portion of the upper tool clamp 11 is pressed by the welding force of the dish spring 51. As a result, the upper tool clamp 11 is pivoted counterclockwise in FIG. 8. By the pressing member 35 which is mounted on the lower portion of the upper tool clamp 11, the pressing force of the coil spring 33 is resisted in order to push the upper portion 5U of the upper tool 5. Thereby, the upper tool 5 can be incompletely clamped easily between the upper tool clamp 11 and the upper tool support portion 9.

After then, a table is moved upward and downward at a movable side of the press brake so that the upper tool 5 is engaged with the lower die (not shown). Thereby, the upper tool 5 can rise relatively between the upper tool support portion 9 and the upper tool clamp 11.

In this case, since the slant surface 5S of the upper tool 5 pushes the pressing member 35, the upper tool 5 rises relatively so that the upper tool clamp 11 can be pivoted clockwise. The three-threaded screw 61 pushes gradually the pusher portion 49 of the first clamp, unclamp device 13, so that the store force of the dish spring 51 is increased gradually. Accordingly, the upper tool clamp 11 is pushing and fixing the upper tool 5 gradually and forcefully in order to be completely clamped.

Figure 11:
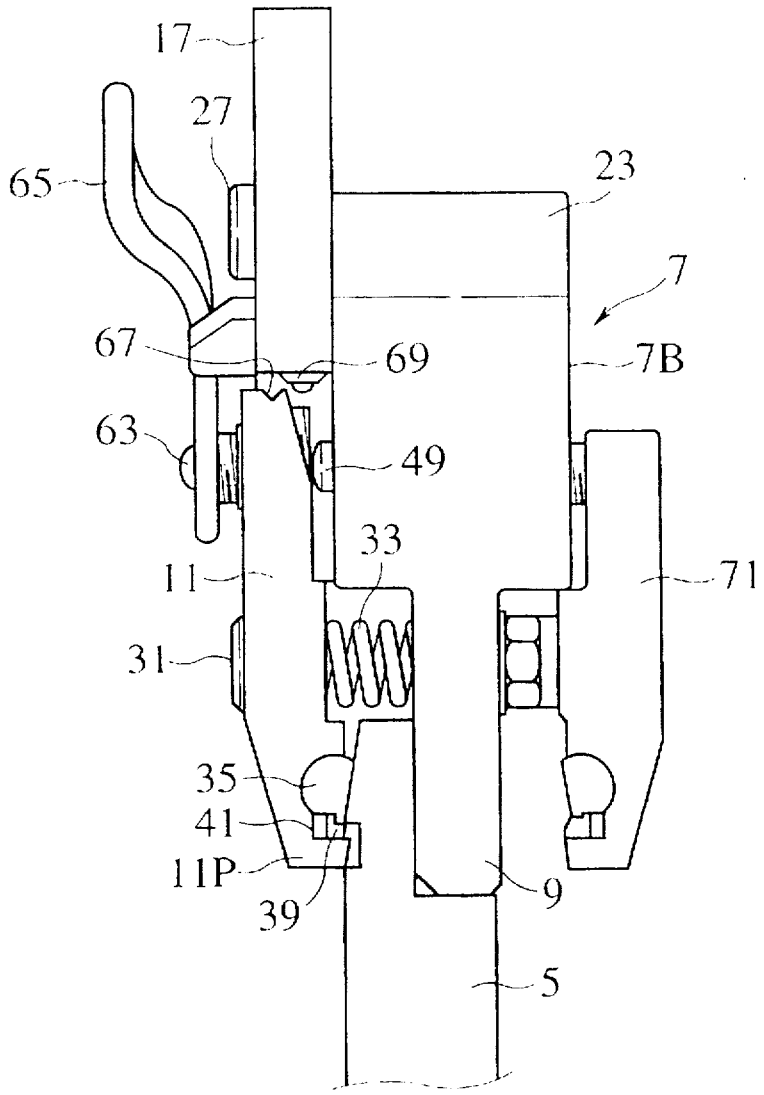
FIG. 11 is an illustration for assistance in explaining the effect when the upper tool is clamped and unclamped from the upper tool holder apparatus, according to an aspect of an upper tool holder apparatus for a press brake of the present invention.

When a shoulder portion of the upper tool 5 is attached to a lower end surface of the upper tool support portion 9, the upper tool 5 is pressed and fixed to the upper tool support portion 9 by the upper tool clamp 11. Further, as shown in FIG. 11, the wedge piece 39 is engaged with the drop prevention groove 5G of the upper tool 5, so that the clearance between the engage projection 11P and the drop prevention groove 5G is reduced.

As described above, the wedge piece 39 is engaged with the drop prevention groove 5G of the upper tool 5 so that the clearance between the engage projection 11P and the drop prevention groove 5G remains reduced. In this case, even if the upper tool clamp 11 is released from pushing and fixing, the upper tool 5 does not drop due to its self-weight.

As described above, the upper tool clamp 11 pushes and fixes the upper tool 5 to the upper tool support portion 9 tightly, so that the work is bent altogether by an operation of the lower die. After then, in order to remove the upper tool 5, the operation lever 65 is pivoted to position B as shown in FIG. 7, so that the upper tool 5 can be unclamped easily.

Figure 12:
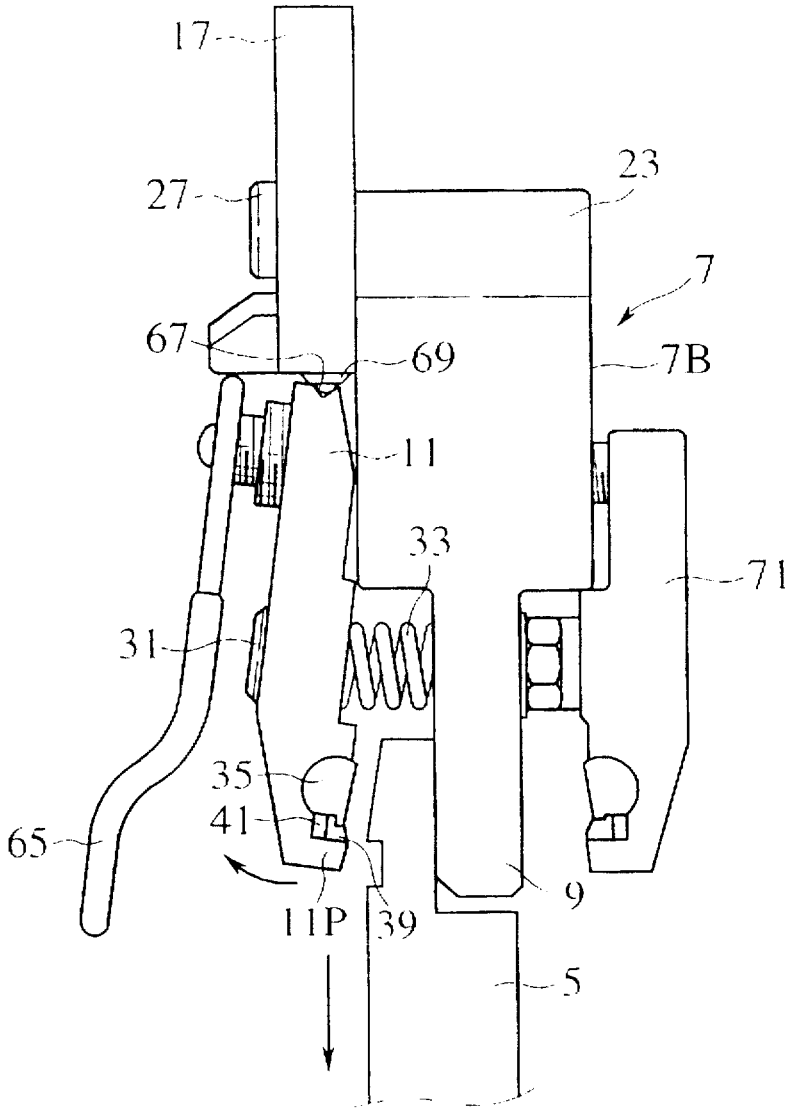
FIG. 12 is an illustration for assistance in explaining the effect when the upper tool is clamped and unclamped from the upper tool holder apparatus, according to an aspect of an upper tool holder apparatus for a press brake of the present invention.

After then, the operation lever 65 is pivoted at position A as shown in FIG. 2. As shown in FIG. 12, the reaction force of the pressing and welding means 12 is resisted so that the lower side of the upper tool 5 is pivoted at this side. The engage concave portion 67 which is mounted on the upper portion of the upper tool clamp 11 is engaged with the ball plunger 69, so that the lower portion of the upper tool clamp 11 is open in order to be separated from the upper tool support portion 9. By pulling the upper tool 5 downward, it is possible to push the upper tool 5 forward in order to remove the upper tool 5 downward from the upper tool clamp 11, etc.

Figure 6:
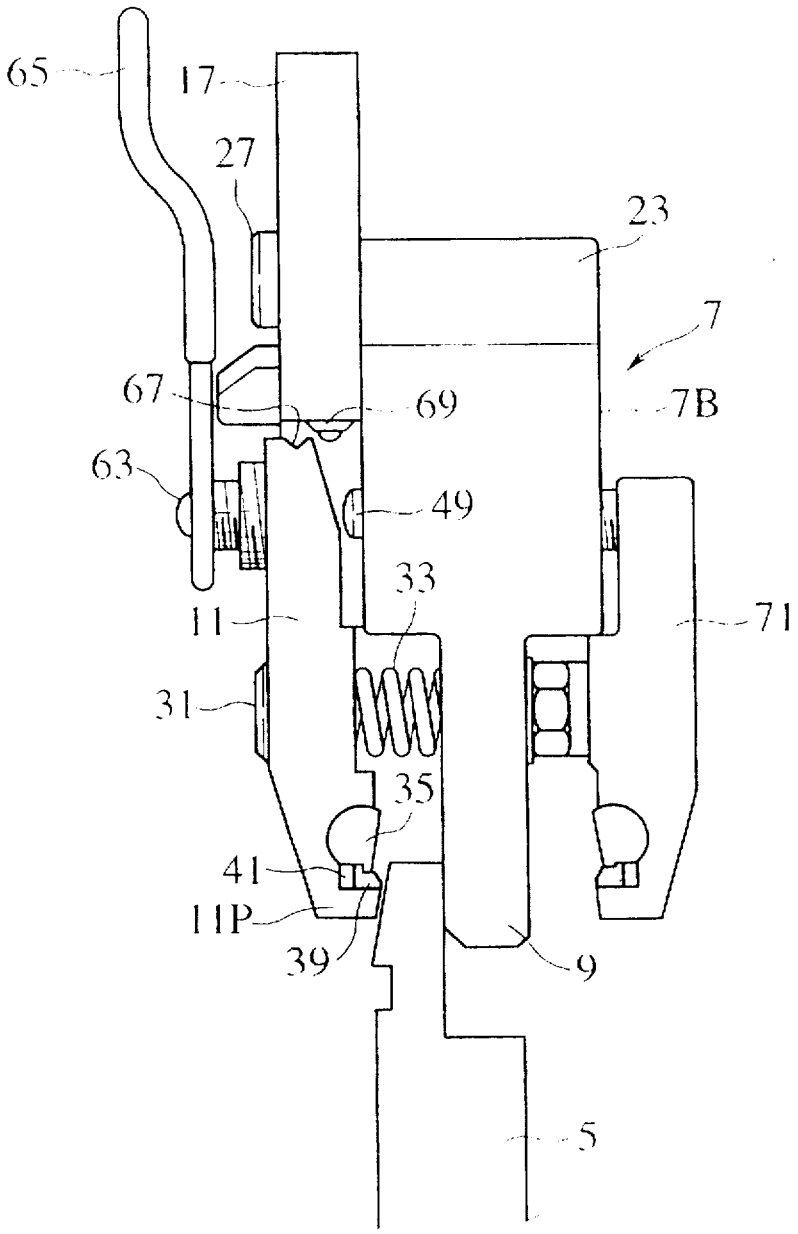
FIG. 6 is an illustration for assistance in explaining the effect when the upper tool is clamped and unclamped on the upper tool holder apparatus, according to an aspect of an upper tool holder apparatus for a press brake of the present invention.

Thus, after removing the upper tool 5 in the downward direction, the upper tool holder apparatus 1 is changed to the state as shown in FIG. 6. Accordingly, as described above, the upper tool 5 is entered forward from the lower direction of the upper tool holder apparatus 1 in order to be mounted.

The present invention is not restricted to the examples of above-mentioned embodiment. Accordingly, with appropriate modifications, other embodiments can be obtained.

What is claimed is:

1. An upper tool holder apparatus for a press brake including an upper table with a lower end, said upper tool holder being adapted to hold in the press brake an upper tool having a drop prevention groove, said upper tool holder comprising:

a holder body removably mounted on the lower end of the upper table, said holder body including an upper tool support portion for supporting said upper tool, said upper tool support portion extending in a vertical direction;

first and second upper tool clamps which are arranged on opposite sides of said holder body, each of said upper tool clamps being supported by said holder body so as to be movable relative to said holder body, each of said upper tool clamps having an upper portion and a lower portion, each of said upper tool clamps further including a pressing portion at the lower portion of said upper tool clamp so as to press said upper tool to said upper tool support portion when said upper tool clamp is moved to a clamped state;

an engage projection that is freely engageable with said drop prevention groove formed on said upper tool, said engage projection being formed at the lower portion of at least one of said upper tool clamps;

first clamp/unclamp means mounted on said holder body, said first clamp/unclamp means pressing the upper portion of said first upper tool clamp so that said upper tool is clamped by said first upper tool clamp, and releasing the upper portion of said first upper tool clamp so that said upper tool is unclamped by said first upper tool clamp; and a slide bar supported by said holder body so as to be slidable in a horizontal direction, said slide bar including a rack;

wherein said first clamp/unclamp means comprises a female screw supported by said holder body, a male worm screw engaging with said female screw and having a first end and a second end, a pinion gear integrally connected with said male worm screw at the first end of said male worm screw, a pusher portion formed on the first end of said male worm screw to press the upper portion of said first upper tool clamp and a spring provided between the second end of said male worm screw and the upper portion of said second upper tool clamp; and wherein said rack of said slide bar engages with said pinion gear of said first clamp/unclamp means so that, when said slide bar slides towards one direction, said male screw worm moves towards and presses the upper portion of said first upper tool clamp with said pusher portion, and when said slide bar slides towards another direction, said male screw worm moves towards and presses the upper portion of said second upper tool clamp through said spring.

2. An upper tool holder apparatus for a press brake of claim 1, further comprising:

second clamp/unclamp means mounted on the upper portion of said first upper tool clamp, said second clamp/unclamp means pressing the upper portion of said first upper tool clamp so that said upper tool is clamped by said first upper tool clamp, and releasing the upper portion of said first upper tool clamp so that said upper tool is unclamped by said first upper tool clamp; and an operation lever pivotably mounted on one of said first and second upper tool clamps for operating said second clamp/unclamp means.

3. An upper tool holder apparatus for a press brake of claim 1, wherein a plurality of holder bodies are mounted on said upper table of the press brake, and said first clamp/unclamp means is mounted in each of said holder bodies; and further wherein each of said holder bodies further comprises a slide bar movable in a right and left direction in order to operate said first clamp/unclamp means so as to be coupled and shut off by a coupling member.

4. An upper tool holder apparatus for a press brake of claim 2, wherein said second clamp/unclamp means comprises a three-threaded screw which is integrated with said operation lever in order to be engaged with a female screw of said first upper tool clamp.

5. An upper tool holder apparatus for a press brake of claim 2, wherein said upper tool is clamped by said first upper tool clamp with said first claim/unclamp means and aid second clamp/unclamp means so that a clamp position of said first upper tool clamp is precisely positioned.

6. An upper tool holder apparatus for a press brake of claim 2, wherein said upper tool is clamped by said first upper tool clamp with said first clamp/unclamp means and said second clamp/unclamp means so that a clamp position of said first upper tool clamp may be positioned at one of two positions.

7. An upper tool holder apparatus for a press brake of claim 1, wherein said spring of said first clamp/unclamp means comprises a dish spring.

8. An upper tool holder apparatus for a press brake including an upper table with a lower end, said upper tool holder being adapted to hold in the press brake an upper tool having a drop prevention groove, said upper tool holder comprising:

a holder body removably mounted on the lower end of the upper table, said holder body including an upper tool support portion for supporting said upper tool, said upper tool support portion extending in a vertical direction;

first and second upper tool clamps which are arranged on opposite sides of said holder body, each of said upper tool clamps being supported by said holder body so as to be movable relative to said holder body, each of said upper tool clamps having an upper portion and a lower portion, each of said upper tool clamps further including a pressing portion at the lower portion of said upper tool clamp so as to press said upper tool to said upper tool support portion when said upper tool clamp is moved to a clamped state;

an engage projection that is freely engageable with said drop prevention groove formed on said upper tool, said engage projection being formed at the lower portion of at least one of said upper tool clamps;

a first clamp/unclamp device, mounted on said holder body, that presses the upper portion of said first upper tool clamp so that said upper tool is clamped by said first upper tool clamp, and that releases the upper portion of said first upper tool clamp so that said upper tool is unclamped by said first upper tool clamp; and a slide bar supported by said holder body so as to be slidable in a horizontal direction, said slide bar including a rack;

wherein said first clamp/unclamp device comprises a female screw supported by said holder body, a male worm screw engaging with said female screw and having a first end and a second end, a pinion gear integrally connected with said male worm screw at the first end of said male worm screw, a pusher portion formed on the first end of said male worm screw to press the upper portion of said first upper tool clamp and a spring provided between the second end of said male worm screw and the upper portion of said second upper tool clamp; and wherein said rack of said slide bar engages with said pinion gear of said first clamp/unclamp device so that, when said slide bar slides towards one direction, said male screw worm moves towards and presses the upper portion of said first upper tool clamp with said pusher portion, and when said slide bar slides towards another direction, said male screw worm moves towards and presses the upper portion of said second upper tool clamp through said spring.

9. An upper tool holder apparatus for a press brake of claim 8, further comprising:

a second clamp/unclamp device, mounted on the upper portion of said first upper tool clamp, that presses the upper portion of said first upper tool clamp so that said upper tool is clamped by said first upper tool clamp, and that releases the upper portion of said first upper tool clamp so that said upper tool is unclamped by said first upper tool clamp; and an operation lever pivotably mounted on one of said first and second upper tool clamps for operating said second clamp/unclamp device.

10. An upper tool holder apparatus for a press brake of claim 8, wherein a plurality of holder bodies are mounted on said upper table of the press brake, and said first clamp/unclamp device is mounted in each of said holder bodies; and further wherein each of said holder bodies further comprises a slide bar movable in a right and left direction in order to operate said first clamp/unclamp device so as to be coupled and shut off by a coupling member.

11. An upper tool holder apparatus for a press brake of claim 9, wherein said second clamp/unclamp device comprises a three-threaded screw which is integral with said operation lever in order to be engaged with a female screw of said first upper tool clamp.

12. An upper tool holder apparatus for a press brake of claim 9, wherein said upper tool is clamped by said first upper tool clamp with said first claim/unclamp device and said second clamp/unclamp device so that a clamp position of said first upper tool clamp is precisely positioned.

13. An upper tool holder apparatus for a press brake of claim 9, wherein said upper tool is clamped by said first upper tool clamp with said first clamp/unclamp device and said second clamp/unclamp device so that a clamp position of said first upper tool clamp may be positioned at one of two positions.

14. An upper tool holder apparatus for a press brake of claim 8, wherein said spring of said first clamp/unclamp device comprises a dish spring.

* * * * *

UNITED STATES PATENT AND TRADEMARK OFFICE

CERTIFICATE OF CORRECTION

PATENT NO. : 5,794,486

DATED : August 18, 1998

INVENTOR(S) : M. SUGIMOTO et al.

It is certified that error appears in the above-identified patent and that said Letters Patent is hereby corrected as shown below:

At column 12, line 41 (claim 4, line 3) of the printed patent, change "integrated" to ---integral ---.

At column 12, line 46 (claim 5, line 3) of the printed patent, change "claim/unclamp" to ---clamp/unclamp---.

At column 12, line 47 (claim 5, line 4) of the printed patent, change "aid" to ---said---.

Signed and Sealed this

Sixteenth Day of November, 1999

*Attest:*

Q. TODD DICKINSON

*Attesting Officer*

*Acting Commissioner of Patents and Trademarks*